US005622308A

United States Patent [19]

Ito et al.

[11] Patent Number: 5,622,308

[45] Date of Patent: Apr. 22, 1997

[54] PAPER CONTAINER FOR FLUID SUBSTANCES, AND INSIDE LID THEREFOR

[75] Inventors: Shinobu Ito, Funabashi; Keisuke Kaiho; Kunihiko Ozaki, both of Tokyo, all of Japan

[73] Assignee: Toyo Ink Manufacturing Co., Ltd., Tokyo, Japan

[21] Appl. No.: 430,740

[22] Filed: Apr. 28, 1995

[51] Int. Cl.[6] ..... B65D 5/40

[52] U.S. Cl. ..... 229/198.2; 229/4.5; 229/5.5; 229/400

[58] Field of Search ..... 229/4.5, 5.5, 3.1, 229/198.2, 400, 404

[56] References Cited

U.S. PATENT DOCUMENTS

| | | | |
|---|---|---|---|
| 3,079,059 | 2/1963 | Kuchenbecker | 229/198.2 |
| 3,137,431 | 6/1964 | Crouse et al. | 229/400 |
| 3,182,882 | 5/1965 | Aellen, Jr. et al. . | |
| 3,988,521 | 10/1976 | Fumel et al. . | |
| 4,117,971 | 10/1978 | Itoh . | |

FOREIGN PATENT DOCUMENTS

| | | | |
|---|---|---|---|
| 1359243 | 3/1964 | France | 229/4.5 |
| 7-9714 | 2/1995 | Japan . | |

*Primary Examiner*—Gary E. Elkins

*Attorney, Agent, or Firm*—Knobbe, Martens, Olson & Bear, LLP.

[57] ABSTRACT

A paper container for fluid substances. It comprises: a tapered trunk portion formed by rolling a sheet comprising a layer having a barrier ability applied onto a surface of cardboard, in a state in which the layer is disposed inside, and by joining longitudinal-directional ends of the sheet with each other; and a bottom member formed from a disk-shaped sheet comprising a layer having barrier ability applied onto a surface of cardboard, a lower end portion of the trunk portion and a peripheral portion of the bottom portion member being engaged and jointed with each other in such a manner that the respective layers face each other. A first end portion for forming a joint portion of the trunk portion has an extending film which surrounds an end surface of the cardboard and reaches an external surface of the cardboard. A second end portion of the joint portion has a stepped portion which bends outside from an end-surface position of the first end portion and which extends along an external surface of the first end portion. An inner film of the second end portion are directly or indirectly joined with the extending film of the first end portion.

17 Claims, 5 Drawing Sheets

PAPER CONTAINER FOR FLUID SUBSTANCES, AND INSIDE LID THEREFOR

BACKGROUND OF THE INVENTION

1. Field of the Invention

The present invention relates to a paper container for fluid substances, and an inside lid used therefor.

2. Description of the Related Art

It is necessary that a container for accommodating fluid substances which are relatively heavy-weight and have the property of oxidizing or evaporating, should possess satisfactory strength, seeping-preventing efficiency, gas-shutoff efficiency and the like. Printing ink represented by, for example, letterpress ink, intaglio plate ink and planographic ink is a high viscosity substance containing volatile matters, in which pigments, lakes and dyes are kneaded into a vehicle. Thus, conventionally, a container therefor has been used in which a trunk member, a bottom member and a lid member are generally formed of metal plates such as a tin plate and steel plate and are manufactured as a can by plate drawing. Although this structure ensures sufficient strength, its heavy weight results in an increase in the transportation costs of containers. In addition, there exist drawbacks in that, since the sealing efficiency of joints of the container is insufficient, infiltration of air may cause the contents of the container to be oxidatively polymerized to be hardened. Further, there also exist drawbacks in that, since this type of container is not combustible and the contents adhere to the container even after use of the container, it is difficult to dispose of the used container and the cost for disposing of the same may increase exceedingly.

For this reason, a jointless container formed by deep-drawing a metal plate has also been used. However, in this type of container as well, there exist drawbacks in that the container is heavy-weight and the cost of manufacturing the same is very high, and that the used containers occupy a large amount of space and are not easy to be disposed of.

Further, fluid substances such as oxidatively-polymerizing printing ink represented by offset ink, polymerizing paints and a reactively-hardening adhesive agent (particularly, offset ink) have high viscosity and are difficult to neatly and quickly be taken out from a container. For this reason, these fluid substances have been often used after their viscosity is lowered by letting them together with the containers into an oven and then heating the contents in advance so that the contents can easily be taken out from the containers. However, heating by using an oven requires a considerable time until the contents entirely get warm. In addition, since it is difficult to heat the contents uniformly, there exists a drawback in that, the fluid substance at a portion near a heat source is excessively heated and an undesirable phenomenon such as skinning may appear. Therefore, there has also been a demand for a container which overcomes this drawback and for which a preferable heating process can be utilized.

SUMMARY OF THE INVENTION

It is therefore an object of the present invention to provide a paper container for fluid substances, having sufficient strength and light-weight.

It is another object of the present invention to provide a paper container for fluid substances which has excellent barrier ability or sealing efficiency against a liquid, gas or the like.

It is yet another object of the present invention to provide a paper container for fluid substances which can easily be disposed of after use thereof.

It is a further object of the present invention to provide a paper container for fluid substances which can improve the take-out efficiency of the contents.

It is also an object of the present invention to provide an inside lid which is suitable for use in the above-described paper container.

Other objects of the invention will be apparent by reference to the following detailed description.

In order to achieve the above-described objects, the present inventors have considered using a container mainly made of paper. In this case, in view of maintaining the integral container even when the content of the container is a relatively heavy-weight fluid substance, they have used cardboard. Further, in order to prevent seeping, oxidation or evaporation of the contents, a coating film having barrier ability is provided. It is preferable that, in view of the aspect of cost, the container be formed by rolling one-sheet paper and joining ends thereof, and then by joining the roll-shaped paper with a bottom plate. However, using only this structure causes a stepped portion to be formed at the joining portion because of using the cardboard, and the sealing efficiency is impaired due to a gap which is caused by the stepped portion. Accordingly, the present invention is also directed to overcome a drawback based on the stepped portion by using a special structure.

In accordance with the present invention, there is provided a paper container for fluid substances, which comprises: a tapered trunk portion (body portion) formed by rolling a sheet comprising a layer (e.g., coating layer) having barrier ability applied onto a surface of cardboard, in a state in which the layer is disposed inside, and by joining longitudinal-directional ends of the sheet with each other; and a bottom member formed from a disk-shaped sheet comprising a layer having barrier ability applied onto a surface of cardboard, a lower end portion of said trunk portion and a peripheral portion of said bottom member being engaged and jointed with each other in such a manner that the respective layers face each other, wherein a first end portion for forming a joint portion of said trunk portion has an extending film which surrounds an end surface of the cardboard and reaches an external surface of the cardboard, and a second end portion of the joint portion has a stepped portion which bends outside from an end-surface position of the first end portion and which extends along an external surface of the first end portion, an inner film of the second end portion being directly or indirectly (i.e., through any other layer(s)) joined with the extending film of the first end portion.

The wording "the respective layers face each other" specifically means that the layers face each other, directly or through any other layer(s). That is, the layers are present at least inside the container.

The cardboard used in the present invention has a thickness sufficient to cause no trouble in normal transport even when a fluid substance to be used is filled in the container. Usually, the thickness thereof is 0.2 mm to 1.0 mm, and preferably, it is 0.4 mm to 0.7 mm. The cardboard is required to have good press strength and a second-process ability.

The barrier ability defined in the present invention means having the shutoff efficiency or resistance which is higher than the cardboard, against one or more substances such as a liquid (e.g., water), oil and fluid substances. It is determined, dependently on uses of the containers of the present invention and situations in which they are used, what the substance specifically is, and by what degree the shutoff efficiency or resistance is higher than the cardboard.

For example, in a coating agent of ink or the like, at least one of a water resisting property, an oil resisting property and gas barrier ability is concerned in the barrier ability. Preferably, all of them are concerned in the barrier ability.

When the water resisting property is concerned in the barrier ability, the barrier ability indicates the water resisting property being higher than the cardboard. Specifically, the water resisting property preferably indicates that the tensile strength of a test piece after being immersed in water of 25° C. for 60 minutes is a value of 80 or more assuming that the strength before immersion is given as 100. More preferably, it is greater than or equal to 90.

When the oil resisting property is concerned in the barrier ability, the barrier ability indicates the oil resisting property being higher than the cardboard. Specifically, the oil resisting property preferably indicates that the tensile strength of the test piece after being immersed in oil (for example, linseed oil) of 50° C. for 720 hours is a value of 80 or more assuming that the strength before immersion is given as 100. More preferably, it is greater than or equal to 90.

When the gas barrier ability is concerned in the barrier ability, the barrier ability indicates the gas barrier ability being larger than the cardboard. Specifically, the gas barrier ability preferably indicates that the value of gaseous oxygen permeability at 25° C., which was measured in accordance with ASTM D 3985, is 100 $ml/m^2$ 24 hr latm or less, more preferably 10 $ml/m^2 \cdot 24$ hr·latm or less, and most preferably, 1 $ml/m^2 \cdot 24$ hr·latm or less.

In the present invention, the layer having the above-described barrier ability may be formed in any method and may be a monolayer or multilayer. The layer is suitably composed of a composite multilayer film of plastic and an inorganic deposit layer (which is substantially the same as an inorganic deposit layer of an inside lid described below and whose composition should be referred to a specific explanation of the inside lid) such as silicon oxide or aluminium oxide. The inorganic deposit layer exhibits stable barrier ability independently of changes of ambient atmosphere such as temperature and humidity. Further, a composite multilayer film may be used which is composed of an organic barrier film such as part-saponified ethylene/vinyl acetate copolymer or polyvinylidene chloride, and other synthetic resin layer.

The present invention is suitable for the container for printing ink, and can also be used as a container for various types of fluid substances which have heavy-weight and the nature of desiring no oxidation and no evaporation.

For example, the present invention can also be applied to, as well as the container for oxidatively-polymerizing printing ink, a container for paints including oxidatively-polymerizing oil, a container for a reactively-hardening adhesive agent, and the like.

An inside lid which is suitable for use in the above-described container is characterized by forming an inorganic deposit layer (i.e., an inorganic thin-film layer formed by a vacuum thin-film forming method) onto at least one surface, i.e., one side, or both sides of a plastic film.

Since the container for fluid substances of the present invention is made of paper, with a coating film being formed on the surface of the paper, it has light-weight and can be easily transported. Further, since the base material of the container is cardboard, it is strong. For this reason, if a spatula made of, for example, plastic is used, there is no possibility that the container be not broken when the contents therein are taken out.

The used and empty container whose contents have been discharged is constructed in that a trunk portion is formed so as to be tapered toward a lower side, and therefore, these containers can be stacked in a nest form. In the form, the containers can be incinerated by an incinerator so that they can easily be disposed of.

In a case of manufacturing the containers, they can be obtained by joining a composite resin layer as a coating film with the surface of the container by heat, ultrasonic vibration or the like. This results in low-cost products in comparison with a case of using deep-drawing.

In a case in which the trunk portion of the container is formed by simply joining a plurality of cardboard sheets with each other in an overlapping manner, the thickness of the papers are large and a gap is formed between an outer peripheral edge of the bottom member and an inner surface of the trunk member at a joint portion. Thus, the contents may be leaked out from the gap. The contents may seep through the gap. The contents may also be easily oxidized by infiltration of air. However, the present invention is constructed in that an outer end portion (second end portion) in a region of a joint portion reaches an external surface of an inner end portion (first end portion) from an end surface position of the inner end portion via a bending stepped portion. As a result, an internal surface of the trunk portion at the joint region becomes approximately smooth, and therefore, a gap is not formed between the internal surface of the trunk portion and the outer edge of the bottom member. Further, since the end surface of the inner end portion is covered with a film and the film is joined with a film of the outer end portion, the sealing efficiency of the joint portion is satisfactorily achieved. Any of the contents does not leak out at all. Moreover, the joint portion is formed smooth. Thus, there is no risk of the joint portion being broken when the contents are taken out by a spatula.

DESCRIPTION OF THE PREFERRED EMBODIMENTS

Figure 1:
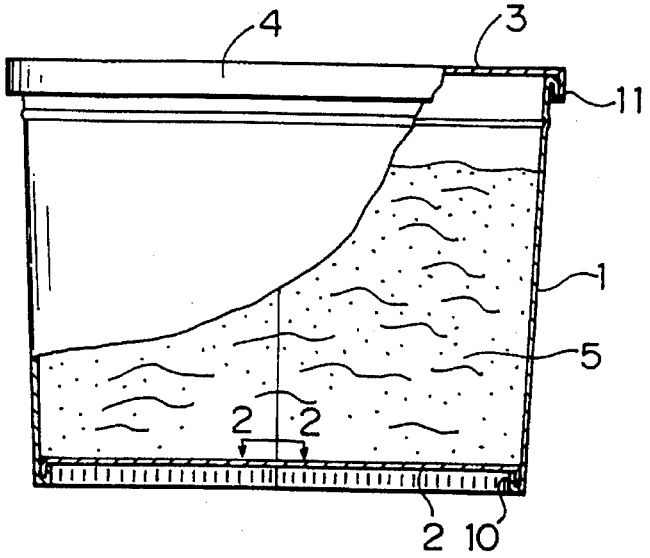
FIG. 1 is a partially-cutaway side view illustrating an embodiment of a paper container for fluid substances according to the present invention.

Referring now to the accompanying drawings, a description will be given of an embodiment of the present invention. FIGS. 1 to 7 show the embodiment in which the present invention is applied to a container for printing ink.

As shown in FIGS. 1 to 4, the container includes a tapered trunk member 1 of which diameter gradually increases from bottom to top, a disk-shaped bottom member 2, a sealing sheet 3 (inside lid), and a lid member 4 mounted on the sealing sheet 3. An inner-folded bending portion 10 is formed at a lower end of the trunk portion 1 and an outer-curling portion 11 is formed at an upper end thereof. An enclosing wall portion 20 extending in a lower direction is formed so as to bend from a peripheral portion of the bottom member 2. The enclosing wall portion 20 is engaged and fitted with and adhered to the bending portion 10. The sealing sheet 3 which has gas barrier ability is joined with the curl portion 11. Printing ink is filled in the container. After the printing ink is filled therein, the container is formed as a gas replacement container by filling inert gas such as nitrogen therein and joining the sealing sheet 3 with the curl portion 11.

Figure 5:
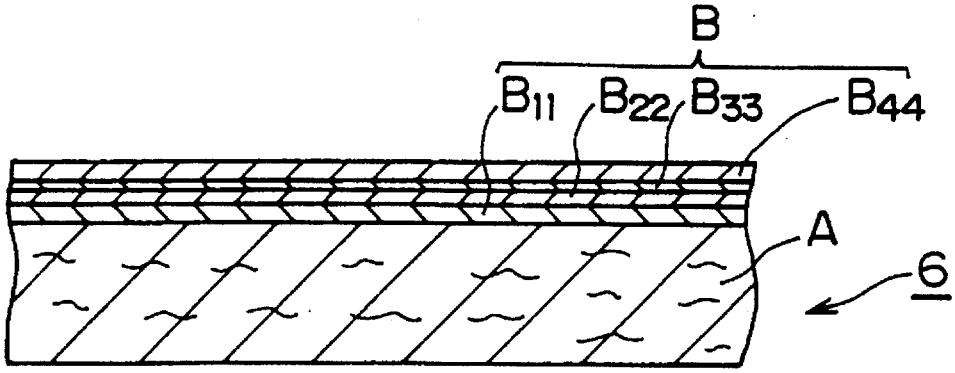
FIG. 5 is an enlarged cross-sectional view of a container-forming material.

In the present invention, at least the trunk member 1 and the bottom member 2 are respectively formed of composite sheets 6 mainly made of paper, each in which a coating film B having satisfactory oil resisting property, water resisting property and gas barrier ability is formed on a surface of a cardboard A as shown in FIG. 5. The cardboard A has a thickness of 0.2 mm or more, preferably 0.4 mm or more, so that the container has sufficient strength. The coating film B is formed of a multilayer structure (i.e., a structure formed by depositing an inorganic film $B_{22}$ represented by silicon oxide onto a base resin layer $B_{11}$ such as polyethylene terephthalate, and laminating thereon an oil-resistant film $B_{44}$ such as linear low-density polyethylene by an adhesives layer $B_{33}$). The lid member 4 may be made of metal or plastic, and preferably, may be formed of the above-described composite sheet 6. Further, if an upper surface of the lid member 4 is formed so as to have a convex portion which engages with a concave portion at a lower side of the bottom member 2, it is convenient for stacking the containers. A film of, for example, polyethylene may be formed on the external surface of the composite sheet 6 to prevent stains and improve water-resistance.

Figure 2:
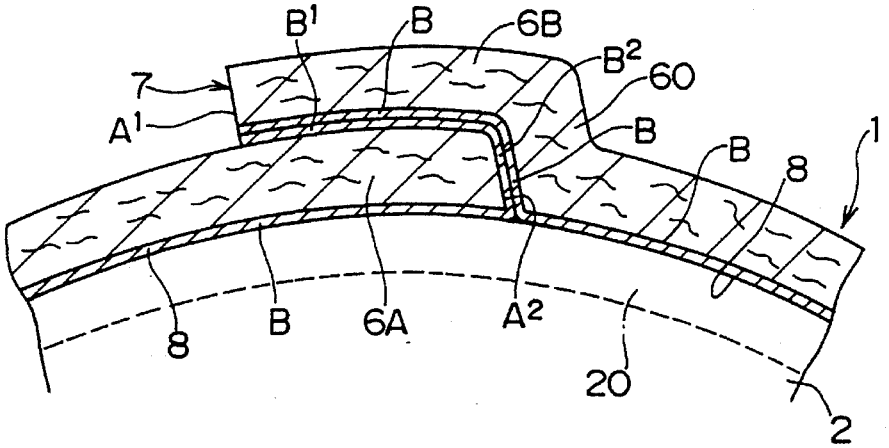
FIG. 2 is an enlarged cross-sectional view taken along the lines 2—2 of FIG. 1.

The trunk portion 1 is formed by cutting the above-described composite sheet 6 in the form similar to a fan shape, rolling the sheet 6 in the form of a ring so that the coating film B is positioned on an inner side, and joining respective coating films B of the overlapping both end portions of the composite sheet in a longitudinal direction thereof. As shown in FIG. 2, a joint portion 7 has no stepped portion on an inner surface thereof and has a surface of the substantially same curvature as that of a trunk inner surface 8, 8 not including the joint portion 7. Joining of the coating films is realized by fusing or semi-fusing resin locally using a heating process, an ultrasonic-vibration applying process, or both of these two process.

Figure 3:
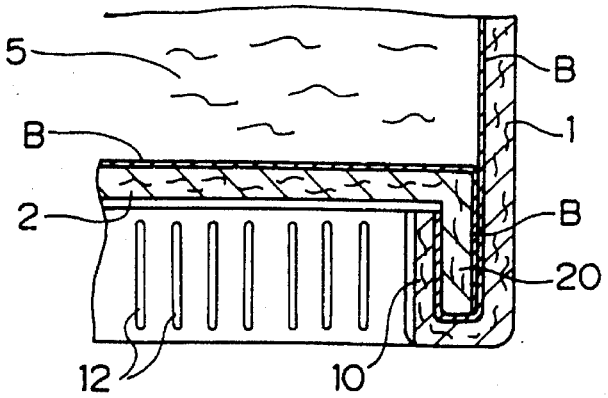
FIG. 3 is an enlarged cross-sectional view of a bottom portion in FIG. 1.
Figure 4:
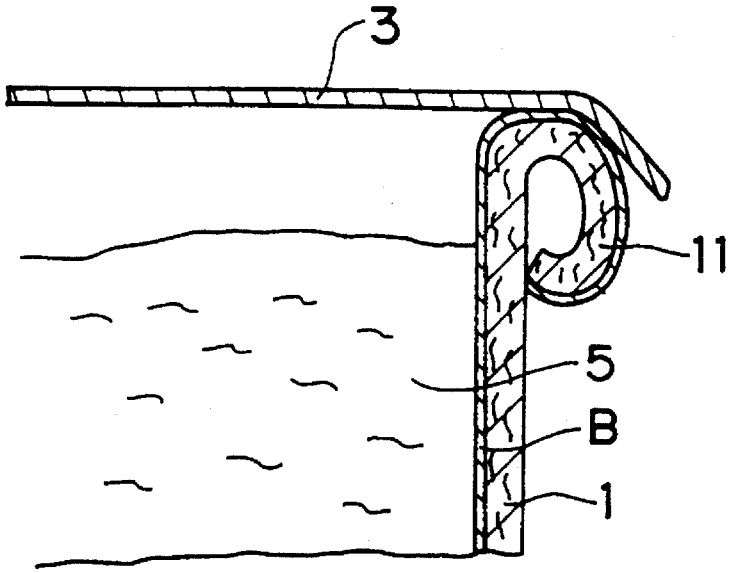
FIG. 4 is an enlarged cross-sectional view of an opening edge portion in FIG. 1.

As shown in FIG. 3, the bottom member 2 is fit in the trunk member 1 so that an external surface of the enclosing wall portion 20 abuts against the trunk inner surface 8. The coating films B, B of these contact surfaces are joined with each other by the above-described technique. The inner surface of the enclosing wall portion 20 is joined with a synthetic resin film layer B of the inner-folded bending portion 10 and are engaged with a knurled portion of a knurl 12. As a result, the bottom portion 2 is integrally formed with the trunk member 1.

The coating film B of the outer-curling portion 11 appears outside and the sealing sheet 3 is joined to the coating film B.

Next, a detailed description will be given of the above-described joint portion 7. In the joint portion 7, a first end portion 6A of the composite sheet 6 in a longitudinal direction thereof is disposed inside and a second end portion 6B in the longitudinal direction of the composite sheet 6 is overlapped onto the external side of the first end portion 6A. The coating film B of the second end portion 6B does not reach the cardboard end surface $A^1$. The coating film B of the first end portion 6A extends so as to continuously form an outer-folded extending coating film $B^1$ having a portion $B^2$ which covers an end surface $A^2$ of the cardboard. The outer-folded extending coating film $B^1$ is formed into a vertical-directional belt form on an outer surface of the cardboard A.

The longitudinal-directional second end portion 6B together with the coating film B project in a radial direction via a bending stepped portion 60 and then extends in a circumferential direction from the projected end of the second end portion 6B. The portion $B^2$ covering the cardboard end surface of the first end portion 6A is joined with the coating film B of the second end portion 6B at an inside of the bending stepped portion, in an overlapping state. The outer-folded extending portion $B^1$ and the coating film B of the second end portion 6B, are joined with each other, from the bending stepped portion 60, in an overlapping state.

Figure 6A:
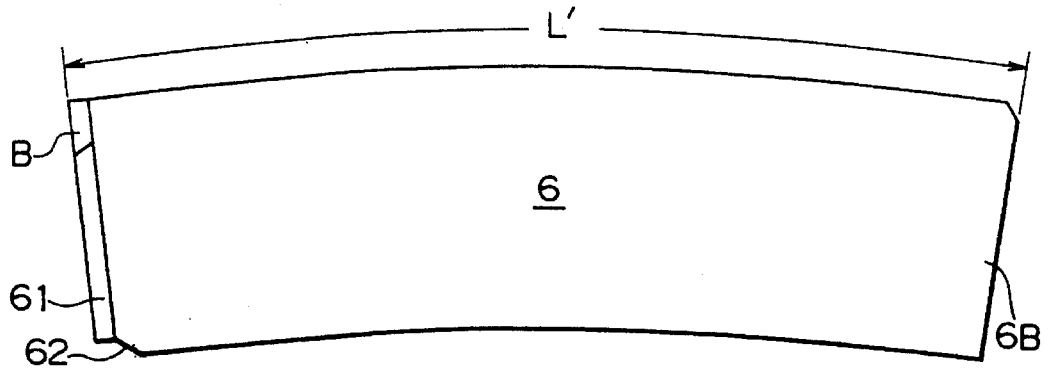
FIG. 6A is a plan view illustrating one processing step of a sheet for a trunk member in the present invention.
Figure 6B:
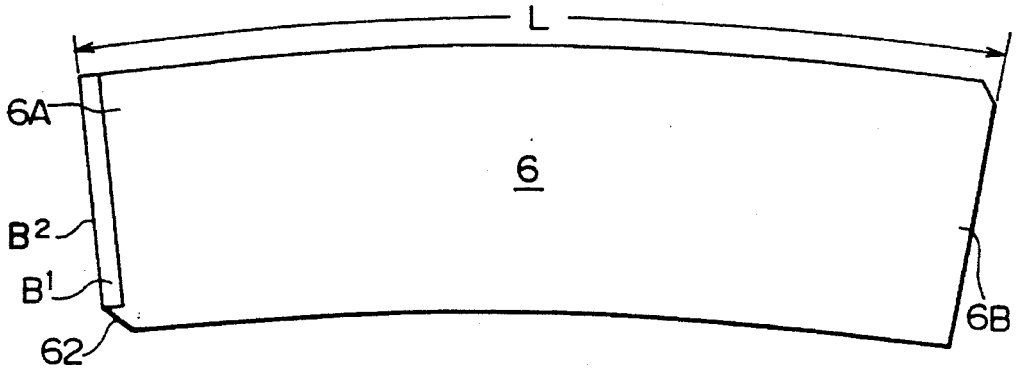
FIG. 6B is a plan view illustrating one processing step of a sheet for a trunk member in the present invention, which is subsequent to the processing step shown in FIG. 6A.
Figure 7A:
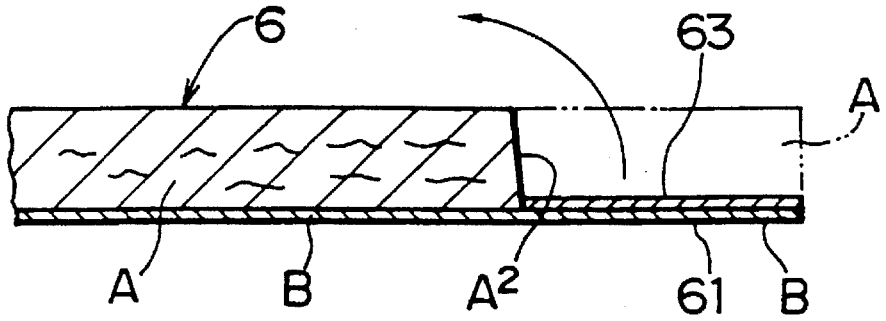
FIG. 7A is an enlarged cross-sectional view illustrating one processing step of the sheet for the trunk member in FIGS. 6A and 6B.
Figure 7B:
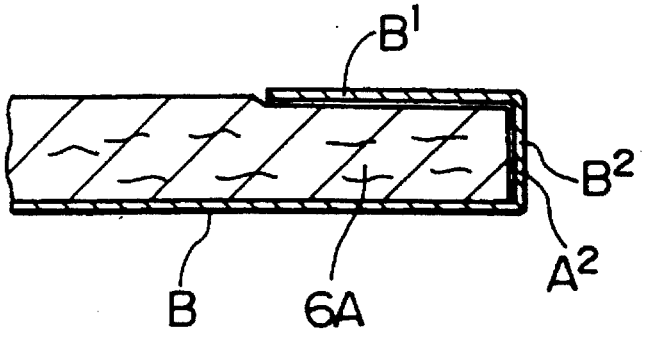
FIG. 7B is an enlarged cross-sectional view illustrating one processing step of the sheet for the trunk member in FIGS. 6A and 6B, which is subsequent to the processing step shown in FIG. 7A.

The above-described joint portion 7 is formed as follows. Namely, as shown in FIGS. 6A and 6B, the composite sheet 6 is cut to a dimension L' which is moderately longer than a dimension L required for forming the trunk portion of the container. Then, as shown in FIGS. 6A and 7A, at the side of the longitudinal-directional first end portion 6A, the cardboard A is removed to the limit at which a back surface of the coating film B is exposed or a thin-paper layer remains, so as to form a reversely-turning and extending thin-layer portion 61. Further, the thin-layer portion 61 is bent toward the side of the sheet back surface and joined with a back surface of the cardboard A by an adhesive agent 63 (When a film of, for example, polyethylene is formed on the external surface of the composite sheet 6, the adhesive agent 63 can be omitted). As a result, the outer-folded extending coating film B1 is formed as shown in FIGS. 6A and 7B. It should be noted that a slanting-cut portion 62 is formed at the longitudinal-directional first end portion 6A and at a corner near the outer-folded extending coating film B1 so that the inner-folded bending portion 10 can easily be formed.

Figure 8:
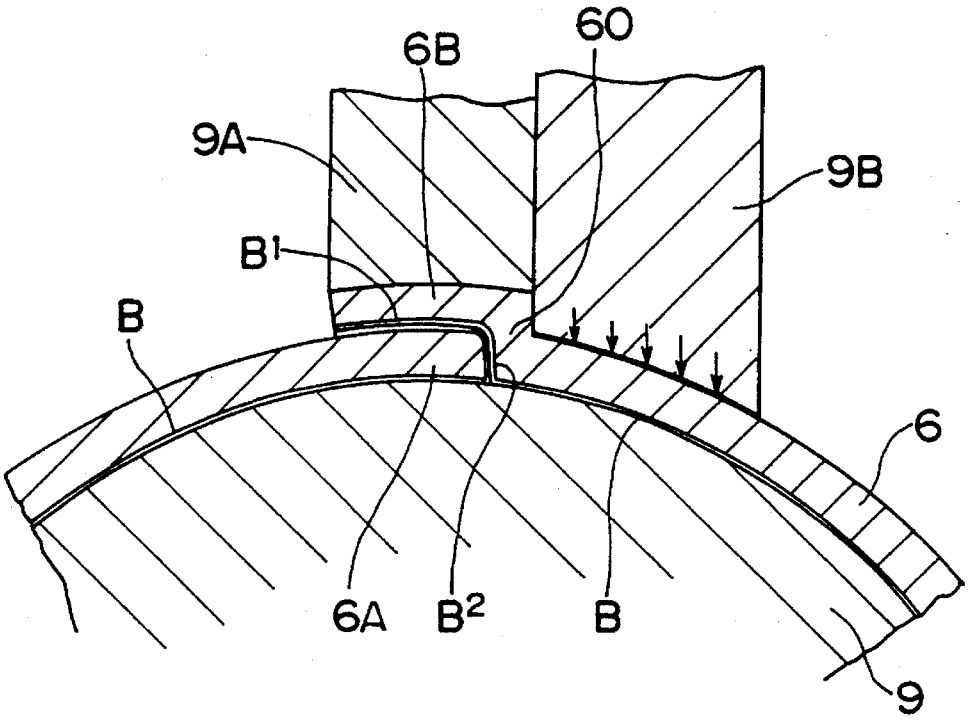
FIG. 8 is a partially cross-sectional view illustrating a state in which the trunk member is being formed in the present invention.

Subsequently, as shown in FIG. 8, the composite sheet 6 is turned around a taper mandrel 9 so that the second end portion 6B is superposed on the first end portion 6A, and in this state the composite sheet 6 is pressed against the taper mandrel 9 from the outer side by a metal piece 9A (i.e., a heating piece, high-frequency vibration piece or ultrasonic-vibration piece). At the same time, a pressing piece 9B is pressed against an outer side of the composite sheet 6 immediately near the first end portion 6A. As a result, an inner side of the second end portion 6B tightly contacts the taper mandrel 9, and thus a flat inner surface which is fitted with the first end portion 6A is formed. At the same time, the bending stepped portion 60 is formed by a lateral surface of the heating piece 9B and is subjected to heat or vibration by the joint member. For this reason, the bending stepped portion 60, the coating film B extending therefrom, and the outer-folded extending coating film $B^1$ are joined with together.

It should be noted that, according to circumstances, the bending stepped portion 60 may be formed in advance in a state of the composite sheet 6 by press molding or the like.

The container for printing ink according to the present embodiment is light-weight since at least the trunk member 1 and the bottom member 2 are made of composite materials mainly composed of paper. Further, since the thickness of the paper is large, the strength of the container is high. For this reason, when the printing ink having viscosity is taken out by a spatula, the container is not easy to break even if the spatula abuts against the surface of the container.

Since the contact surface with the printing ink 5 is formed by the coating film B having the excellent gas barrier ability, oil-resisting property and water-resisting property, there is no possibility that volatile matters of a solvent leak out, solid substances (liquid substances) leak out, or outside all enters the container. The trunk portion 1 is formed in a state in which the first end portion 6A and the second end portion 6B are overlapped and joined with each other. However, a stepped portion caused by the thickness of paper does not appear on the inner-surface side of the trunk portion of the container and thus the first end portion 6A and the second end portion 6B are continuously formed with a smooth curvature because the second end portion 6B has the bending stepped portion 60 which rises in a direction of the outer side at an end-surface position of the first end portion 6A.

For this reason, a gap between an outer peripheral edge of the bottom member 2 and the inner surface of the trunk member 1 in the joint portion is not formed and thus no fluid substance or liquid leaks out from the bottom member 2. In addition, the coating film $B^2$ is formed on the end surface $A^2$ of the first end portion 6A, and the coating film B on an inner surface of the bending stepped portion of the second end portion 6B is fused and joined with the coating film B2. Accordingly, very excellent sealing efficiency is maintained and no fluid substance or liquid leaks out from the joint portion. Further, in the joint portion of the outer-curling portion 11 at an upper end portion of the container, a stepped portion does not appear on a sealing surface between the sealing sheet 3 and the outer-curling portion 11. For this reason, infiltration off outside air from the sealing portion is prevented. Accordingly, when, after the contents are filled in the container, inert gas is filled in a space within the container and the container is tightly sealed by the sealing sheet 3 with gas barrier ability, solidification of the printing ink can be prevented.

When the printing ink has been discharged and the container has become empty, the containers can be stacked in a nest form because of an increase, from bottom to top, in the diameter of the trunk portion 1. Thus, no space for storage thereof is required. Further, since the trunk member 1 and the bottom member 2 are formed of composite materials mainly composed of paper, a special disposal processing for dangerous materials is not required. Moreover, since the containers can be incinerated in the same way as normal wastes, each volume of the containers can easily be reduced and the containers can also easily be disposed of.

Further, the container for fluid substances of the present embodiment permits heating using an electronic oven which could not be used in a conventional metallic container or a container having an aluminium foil as an oxygen-shutoff layer, and can improve the efficiency of taking-out high-viscosity contents and can remarkedly reduce a heating time.

Next, a detailed description will be given of an operation and a preferred embodiment of the sealing seat 3, i.e., an inside lid, of the container for printing ink of the above-described embodiment.

Generally, a conventionally-used inside lid is used so as to not let air from an upper surface of the printing ink in it.

In filling the container with the printing ink, displacement of nitrogen may be effected so as to prevent the printing ink from contacting air after the printing ink is filled in the container.

The film used for the inside lid requires the following conditions: (1) air (oxygen) barrier ability; (2) heat-resisting property: the temperature of the filled ink is 40° to 50° C., but depending on a transportation route, it may possibly reach 80° C. or thereabouts. Therefore, no curling, no expansion or contraction, and no hardening should be caused; (3) resistance to solvent: no curling, no expansion or contraction, and no hardening should be caused by ink solvents, and the inside lid should not be affected by the ink solvents; (4) resistance to cold: in a cold district, occurrence of film whitening should be prevented; and (5) ink-peeling property: when the inside lid is peeled off from the container, a large amount of ink should not be attached thereto. The present inventors have found an inside lid which satisfies the above-described requirements and which is suitable for use in combination with the above-described container of the present invention. The inside lid is characterized in that an inorganic deposit layer (i.e., a thin film formed by a vacuum thin-film forming technique) is formed on one side or both sides of a plastic film. Preferably, a heat-fusible resin layer is also formed on at least one side thereof.

The thickness of the above-described plastic film is not particularly limited, and may be set at any of various values according to purposes. Preferably, it is set at any value within a range of 10 to 300 μm. Particularly, it is more preferably 10 to 30 μm.

Examples of plastic films include polyvinyl alcohol (PVA), polyethylene terephthalate (PET), polyethylene-2,6-naphthalate, polybutylene terephthalate, polyethylene, ethylene/vinyl acetate copolymer resin (EVA), polypropylene, polyacrylonitrile, vinyl chloride, nylon, polycarbonate, polystyrene, fluorocarbon resin, acrylic resin, polyurethane, polybutene, polyimide, polymethylpentene, polyphenylene sulfide, polyether imide, polyether ether ketone, polyether sulfone, polysulfone, and the like. Further, it is preferably an oriented film of these resins.

The deposit layer formed on the surface of the plastic film is essentially composed of oxide such as silicon oxide, aluminium oxide, magnesium oxide, calcium oxide, barium oxide, boron oxide, indium oxide, germanium oxide, tin oxide, zinc oxide, titanium oxide, zirconia oxide, cesium oxide or a mixture made of two or more kinds thereof. Among them, those which are essentially composed of silicon oxide, or those which are mainly composed of aluminium oxide are preferable.

It should be noted that, the deposit layer may be a metallic deposit layer depending on uses of the containers of the present invention and situations in which they are used.

The deposit layer essentially composed of silicon oxides includes silicon oxide; silicon oxide and metallic oxide (or metallic fluoride); and the like.

Silicon oxide is not particularly limited if it is referred to as $SiO_X$ (X=1.0 or more, but less than 2.0), and includes SiO, $Si_2O_3$, $Si_3O_4$, and the like. Further, if no bad influence is exerted on a material property, other metallic oxides may also be included. Examples of other metallic oxides include magnesium oxide, co-oxide of silicon and magnesium, calcium oxide, barium oxide, boron oxide, aluminium oxide, indium oxide, germanium oxide, tin oxide, zinc oxide, titanium oxide, zirconia oxide, cesium oxide, and mixtures of these oxides.

The composition ratio when silicon oxide and other metallic oxide are used together is set such that silicon oxides/other metallic oxides=99.5 to 80 mol %/0.5 mol % to 20 mol %.

When the deposit layer is mainly composed of aluminium oxide, the layer may contain silicon oxide, magnesium oxide, calcium oxide, barium oxide, boron oxide, indium oxide, germanium oxide, tin oxide, zinc oxide, titanium oxide, zirconia oxide, cesium oxide, or the like as a subcomponent within a range of 20 mol % or less.

As the vacuum thin-film forming technique for forming the deposit layer on the surface of the plastic film, what is called a PVD method such as vacuum deposition, ion plating, spattering, or the like; or what is called a CVD method such as plasma CVD, microwave CVD, or the like, can be used. In the vacuum-deposition heating method is not particularly limited if deposition droplets called as splash do not occur, or there occurs a little splash to the degree in which it can be removed without difficulties. A conventionally-known heating method can be used, such as high-frequency induction heating, resistance heating or electron-beam heating. Further, a substrate supplying system may be any one of a continuous taking-up system and a sheet feeding system. An evaporation source of vacuum deposition may be a general crucible system, and a system disclosed in U.S. Pat. No. 5,230,923, Japanese Patent Application Laid-Open (JP-A) Nos. 1-252768 and 2-277774 can also be used, in which evaporation materials are consecutively supplied and discharged.

Further, in the vacuum thin-film forming technique for forming the deposit layer on the surface of the plastic film, any method may be used if the thin-film layer finally has a composition of the object. For example, by using a method of directly using evaporative materials of a composition of the object, a method of reacting and evaporating evaporative materials, a method of causing evaporative materials to fly while reacting them with a gaseous phase, a method of reacting evaporative materials by after-treatment, or the like, the deposit layer may obtain a composition of the object. In addition, any two or more of these methods may also be used in combination.

For example, when a deposit layer composed of silicon oxide and metallic fluoride, as evaporative materials, inorganic compounds or organic compounds such as silicon oxide, metallic fluorides, silicon and organic silicon compounds may be used alone. Mixtures thereof may be used. Namely, the deposit layer may be directly formed of a mixture of silicon oxide and a metallic fluoride, and may also be formed by oxidizing or fluoridating a metal or a compound containing a metal such as an organic metallic compound while performing vacuum deposition thereof. Moreover, the deposit layer may be formed by performing vacuum deposition of evaporative materials of a metallic fluoride and silicon onto the plastic film and then oxidizing the deposit layer by after-treatment. A method of oxidation treatment is not limited to any specific one, if it makes it possible to effect oxidation treatment within a range of temperature in which the plastic film does not deteriorate. For example, a method of introducing gaseous oxygen while deposition, an electrical-discharge method, an oxygen plasma method, a post treatment-thermal oxidation method, an ozone oxidation method, and the like may be included.

Similarly, when the deposit layer is mainly composed of aluminium oxide, aluminium oxide is sufficient to be formed at the step in which the deposit layer is finished. A raw material of the deposit layer may be made of any of aluminium or aluminium oxide. As a method of oxidation treatment, the above-described methods can be used.

The thickness of a deposit layer is selected in accordance with the kind of substrates on which the deposit layer is directly formed, required barrier ability, and required optical characteristics. Preferably, it is 50 to 2000 angstroms. More preferably, it is 100 to 1000 angstroms.

Further, the deposit layer may be a double layer or a multi-layer if required features of a finally-resulting layer can be obtained.

The degree of vacuum during vacuum deposition is preferably within a range between $1\times10^{-4}$ torr and $5\times10^{-3}$ torr.

The heat-fusible resin layer may be formed by lamination of heat-fusible films, or may be laminated by a method of applying or extruding heat-fusible materials, or the like. Moreover, it may also be formed by lamination of heat-fusible materials onto a film by a method of coating, extruding, or adhering with an adhesive layer.

The heat-fusible films include polyethylene (PE), linear low-density polyethylene (LLDPE), ethylene/vinyl acetate copolymers resin (EVA), resin formed by partial neutralization of ethylene/methacrilic acid copolymers using a metal (ionomer), polypropylene (CPP), amorphous polyethylene terephthalate (APET), polyvinyl chloride, polyvinylidene chloride, polystyrene, wax, and mixtures thereof.

The heat-fusible materials include polyethylene, ethylene/vinyl acetate copolymers resin (EVA), resin formed by partial neutralization of ethylene-methacrilic acid copolymers using metal (ionomer), polypropylene, polyethylene terephthalate, polyvinyl chloride, polyvinylidene chloride, polystyrene, and mixtures thereof.

Further, the inside lid is preferably provided to have strength to the degree in which adhesion between the container main body and the inside lid is maintained in normal transportation, storing process (easy-peeling efficiency) and have strength to the degree in which the inside lid can be easily opened by hand (i.e., so-called easy-opening efficiency).

The above-described structure and composition of the inside lid is suitable for used in the coating in the container for fluid substances according to the present invention.

Next, the present invention will be more specifically described with reference to examples below.

EXAMPLES

Measurements of gaseous oxygen permeability of the inside lid: Using a measuring device of gaseous oxygen permeability (OXTRAN-100 manufactured by Modern Controls Corp.) according to ASTM D-3985, measurement is effected under the conditions that temperature is 25° C. and humidity is 100% RH.

Ink preservation test: After the container in which ink is filled and an inside lid is tightly sealed has been preserved for two years at temperature of 25° C., the container is opened and evaluated about a hardened state and viscosity of the ink.

Example 1

A silicon oxide-deposited polyester film having a thickness of 12 μm (manufactured by TOYO INK MANUFAC- TURING CO., LTD.: GT1000S) and a biaxial oriented nylon film having a thickness of 15 μm (manufactured by UNITIKA, Ltd.: EMBLEM ONM) were laminated, with the deposit layer being disposed inside, by a polyester laminate adhesive agent (manufactured by TOYO MORTON Ltd.: AD-585) and a hardening agent (manufactured by TOYO MORTON Ltd.: CAT-10) (weight mixture ratio=100/8, dry coating amount 3 g/m$^2$). In addition, a commercially-available easy-peeling film whose thickness is 60 μm (manufactured by TOHCELLO CO., LTD.: CMPS-008C) was laminated onto the side of the nylon film of the above-described laminate body to obtain an inside lid for an ink container. The gaseous oxygen permeability of the inside lid for the ink container was measured. The results of the measurement are shown in Table 1.

On the other hand, a silicon oxide-deposited polyester film having a thickness of 12 μm (manufactured by TOYO INK MANUFACTURING CO., LTD.: GT1000S) and a commercially-available linear low-density polyethylene film having a thickness of 40 μm (manufactured by TOHCELLO CO., LTD.: TUX-HC) were laminated with the deposit layer being disposed inside, by a polyester laminate adhesive agent (manufactured by TOYO MORTON Ltd.: AD-585) and a hardening agent (manufactured by TOYO MORTON Ltd.: CAT-10) (weight mixture ratio=100/8, dry coating amount 3 g/m$^2$). A commercially-available cardboard (weight 450 g/m$^2$) and a polyester film surface of the laminate body were extrudingly laminated with low-density polyethylene into the form of blank sheet. From the sheet, a trunk member and a bottom member were formed. In this way, the paper container in the form illustrated in the drawings was obtained.

The above-described paper container was filled with 1 kg of the offset-printing ink (manufactured by TOYO INK MANUFACTURING CO., LTD.: TK HYPLUS BLUE) in a nitrogen atmosphere and then the inside lid for the ink container was thermally fused under the condition of 160° C., 1 kg/cm$^2$, and one second, and finally the container was tightly sealed thereby. The ink preservation test therefor was performed. The results are shown in Table 1.

Example 2

One sheet of silicon oxide-deposited polyester film (manufactured by TOYO INK MANUFACTURING CO., LTD.: GT1000S) whose thickness is 12 μm was laminated on a laminate body of the silicon oxide-deposited polyester film having a thickness of 12 μm (manufactured by TOYO INK MANUFACTURING CO., LTD.: GT1000S) and a biaxial oriented nylon film having a thickness of 15 μm (manufactured by UNITIKA, Ltd.: EMBLEM ONM), which was obtained by a laminating method similar to that of Example 1, in the method similar to Example 1, with the deposit surface being disposed inside. In addition, a commercially-available heat-sealing polyethylene terephthalate film whose thickness is 40 μm (manufactured by SEKISUI CHEMICAL CO., LTD.: Estina P320), was laminated on the polyester film side of the laminate body in a manner similar to Example 1, to obtain an inside lid for the ink container. The gaseous oxygen permeability of the inside lid for the ink container was measured. The results thereof are shown in Table 1.

On the other hand, a paper container was prepared by using the same method as Example 1, but the low-density polyethylene film was changed to a commercially-available heat-sealing polyethylene terephthalate film whose thickness is 40 μm (manufactured by SEKISUI CHEMICAL CO., LTD.: Estina P320).

The above-described paper container was filled with 1 kg of the offset-printing ink (manufactured by TOYO INK MANUFACTURING CO., LTD.: TK HYPLUS BLUE) in a nitrogen atmosphere and the inside lid for the ink container was thermally fused under the condition of 160° C., 1 kg/cm$^2$, and one second, and finally the container was tightly sealed thereby. The ink preservation test therefor was performed. The results are shown in Table 1.

Example 3

A commercially-available aluminium oxide-deposited polyester film having a thickness of 12 μm (manufactures by TOYO METALLIZING CO., LTD.: VMPET1011) and a biaxial oriented nylon film having a thickness of 15 μm (manufactured by UNITIKA, Ltd.: EMBLEM ONM) were dry-laminated by the same method as Example 1, and therefore, a laminate body was obtained. In addition, commercially-available heat-sealing wax was coated on the nylon film side of the laminate body so that an inside lid for the ink container was obtained. The gaseous oxygen permeability of the inside lid therefor was measured. The results of the measurement are shown in Table 1.

The above-described paper container was filled with 1 kg of the offset-printing ink (manufactured by TOYO INK MANUFACTURING CO., LTD.: TK HYPLUS BLUE) in a nitrogen atmosphere and then the inside lid for the ink container was thermally fused under the condition of 160° C., 1 kg/cm$^2$ and one second, and finally the container was tightly sealed thereby. The ink preservation test therefor was performed. The results are shown in Table 1.

Comparative Example 1

Except that the silicon oxide-deposited film was changed to a commercially-available polyester film whose thickness is 12 μm (manufactured by TOYOBO CO., LTD.: Ester E5101), an inside lid was prepared by the same method as Example 1. The gaseous oxygen permeability of the inside lid for the ink container was measured. The results of the measurement are shown in Table 1.

A paper container, in the same manner as in Example 1, was filled with 1 kg of the offset-printing ink (manufactured by TOYO INK MANUFACTURING CO., LTD.: TK HYPLUS BLUE) in a nitrogen atmosphere and then the inside lid for the ink container was thermally fused under the condition of 160° C., 1 kg/cm$^2$ and one second, and finally the container was tightly sealed thereby. The ink preservation test therefor was performed. The results are shown in Table 1.

TABLE 1

| | Inside lid | gaseous oxygen | Ink preservation test | |
|---|---|---|---|---|
| | lamination structure | permeability* | viscosity | hardening |
| Example 1 | GT//ONM//CMPS | 0.6 | None | None |
| Example 2 | ONM//GT//GT//P320 | 0.1 or less | None | None |
| Example 3 | 1011//ONM//WAX | 1.2 | increasing somewhat | None |
| Comparative Example 1 | E5101//ONM//CMPS | 53 | hardening | hardening |

*ml/m$^2$ · 24 hr · latm

What is claimed is:

1. A paper container for fluid substances, comprising:

a tapered trunk portion formed by rolling a sheet comprising a layer having barrier ability applied onto a surface of cardboard, in a state in which the layer is disposed inside, and by joining longitudinal-directional ends of the sheet with each other; and a bottom member formed from a disk-shaped sheet comprising a layer having barrier ability applied onto a surface of cardboard, a lower end portion of said trunk portion and a peripheral portion of said bottom member being engaged and jointed with each other in such a manner that the respective layers face each other, wherein a first end portion for forming a joint portion of said trunk portion has an extending film which surrounds an end surface of the cardboard and reaches an external surface of the cardboard, and a second end portion of the joint portion has a stepped portion which bends outside from an end-surface position of the first end portion and which extends along an external surface of the first end portion, an inner film of the second end portion being directly or indirectly joined with the extending film of the first end portion.

2. A paper container for fluid substances according to claim 1, wherein the lower end portion of said trunk portion has an engaging portion folded inside, and the peripheral portion of said bottom member has an engaged portion engaged with the engaging portion, the engaging portion and the engaged portion being engaged and fitted with each other.

3. A paper container for fluid substances according to claim 1, wherein said layer is a composite multilayer film comprising an inorganic deposit film applied on at least one side of a plastic film.

4. A paper container for fluid substances according to claim 3, wherein the deposit film comprises silicon oxide.

5. A paper container for fluid substances according to claim 1, wherein the extending film which surrounds the end surface of the cardboard and reaches the external surface of the cardboard is formed by bending a thin-layer portion formed by removing all of the cardboard at an end portion of the sheet or leaving the cardboard in an extremely thin state, and by joining the thin-layer portion with the end surface of the cardboard.

6. A paper container for fluid substances according to claim 1, wherein one of the fluid substances is printing ink.

7. A paper container for fluid substances according to claim 1, wherein an inside lid is joined to an upper end of said trunk portion.

8. A paper container for fluid substances according to claim 7, wherein a curling portion whose film appears at an upper end of said trunk portion is provided, and said paper container is formed as a gas-displacement container by joining an inside lid to the curling portion after gas displacement.

9. A paper container for fluid substances, according to claim 1, wherein said paper container can be heated by an electronic oven.

10. A paper container for fluid substances, comprising:

a tapered trunk member formed by rolling a sheet comprising cardboard and on at least one surface thereof a layer of an inorganic deposit film deposited on at least one side of a plastic film, in a state in which the layer is disposed inside, and by joining longitudinal-directional ends of the sheet with each other; and a bottom member formed from a disk-shaped sheet comprising cardboard and on at least one surface thereof a layer of an inorganic deposit film deposited on at least one side of a plastic film, said trunk member having an engaging portion at a lower end portion thereof, said bottom member having an engaging portion at a peripheral portion thereof, and both engaging portions being engaged, fitted and jointed with each other in a state in which the respective layers face each other, wherein a first end portion for forming a joint portion of said trunk member has an extending film which surrounds an end surface of the cardboard and reaches an external surface of the cardboard, and a second end portion of the joint portion has a stepped portion which bends on a side of an outer diameter from an end surface position of the first end portion and extends along an external surface of the first end portion, an inner film of the second end portion and the extending film of the first end portion being directly or indirectly joined with each other.

11. A paper container for fluid substances according to claim 10, wherein said trunk member has an inner-folded bending and engaging portion at a lower end portion thereof, and said bottom member has a bending and extending portion folded substantially in a vertical direction, both bending and extending portions of said trunk member and bottom member being engaged, fitted and jointed with each other in a state in which the respective layers thereof face each other.

12. A paper container for fluid substances according to claim 10, wherein the deposit film comprises silicon oxide.

13. A paper container for fluid substances according to claim 10, wherein the extending film which surrounds the end surface of the cardboard and reaches the external surface of the cardboard is formed by bending a thin-layer portion formed by removing all of the cardboard at an end portion of the sheet or leaving the cardboard in an extremely thin state, and by joining the thin-layer portion with the end surface of the cardboard.

14. A paper container for fluid substances according to claim 10, wherein one of the fluid substances is printing ink.

15. A paper container for fluid substances according to claim 10, wherein an inside lid is joined to an upper end of said trunk portion.

16. A paper container for fluid substances according to claim 15, wherein a curling portion of which film appears at an upper end of said trunk portion is provided and said paper container is formed as a gas-displacement container by joining an inside lid to the curling portion after gas displacement.

17. A paper container for fluid substances according to claim 10, wherein a knurl is formed at a portion at which the respective engaging portions of said trunk member and said bottom member are engaged with each other.

* * * * *